US005106041A

United States Patent [19]

Jelincic

[11] Patent Number: 5,106,041

[45] Date of Patent: Apr. 21, 1992

[54] TRASHBAG HOLDER WITH FLAT EDGE

[76] Inventor: James J. Jelincic, 3323 Pinkerton Ct., San Jose, Calif. 95148

[21] Appl. No.: 577,648

[22] Filed: Sep. 4, 1990

Related U.S. Application Data

[63] Continuation-in-part of Ser. No. 439,443, Nov. 20, 1989, abandoned.

[51] Int. Cl.[5] ..... B65B 67/04

[52] U.S. Cl. ..... 248/99

[58] Field of Search ..... 248/95-101; 15/257.1, 257.9; 294/55

[56] References Cited

U.S. PATENT DOCUMENTS

| | | | |
|---|---|---|---|
| 960,451 | 6/1910 | Vicary | 248/99 |
| 3,747,653 | 7/1973 | Ringer | 248/99 X |
| 3,934,803 | 1/1976 | Paulus, Jr. | 248/99 |
| 3,998,415 | 12/1976 | D'Antonio et al. | 248/101 |
| 4,159,139 | 6/1979 | Gawedzinski . | |
| 4,548,372 | 10/1985 | Lutzker | 248/99 |
| 4,550,440 | 10/1985 | Rico | 248/99 |
| 4,775,125 | 10/1988 | Borland . | |
| 4,832,291 | 5/1989 | Nelson et al. | 248/99 |

*Primary Examiner*—Alvin C. Chin-Shue
*Attorney, Agent, or Firm*—Robert Samuel Smith

[57] ABSTRACT

A trashbag holder for holding open the mouth of a trashbag to facilitate filling with trash being a generally triangular frame in which one side is a rectangular panel and the other sides are two resilient rods joined together at two ends and whose other ends join opposite ends of the panel. The triangular frame is inserted into the mouth of the bag to maintain the mouth open. A gripper/connector acting with force from the resilient rods secures the lip of the bag to the frame. The holder and bag may be laid on the ground in order to rake debris into the bag or hung from a spike in a wall or post for loading in the vertical position.

14 Claims, 3 Drawing Sheets

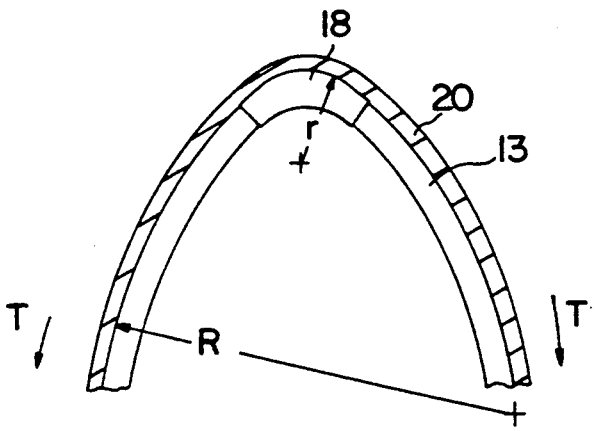
FIG.5
FIG.7A
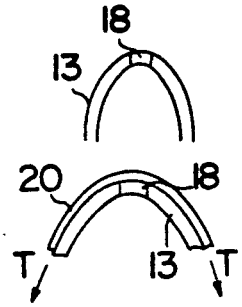
FIG.7B
FIG.6
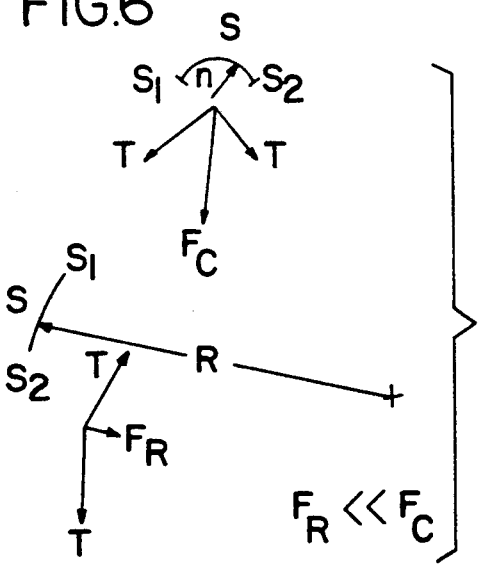
FIG.8
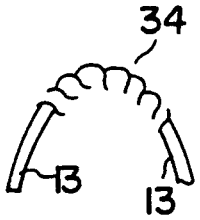

TRASHBAG HOLDER WITH FLAT EDGE

CROSS REFERENCE TO COPENDING U.S. APPLICATION

This application is a continuation-in-part of copending application 439,443 filed Nov. 20, 1989 now abandoned.

BACKGROUND

1. Field of the Invention

This invention relates to devices that facilitate the loading of trash bags and particularly to a device that securely holds open the bag lying on the ground while trash is swept into the bag.

2. Background and Information Disclosure Statement

In general, requirements for devices which assist in sweeping debris, such as leaves, into trash bags are as follows:

the device should be capable of providing a frame around which the mouth of the bag is arranged so that the bag is open when the device is inserted into the mouth of the bag;

the device should be arangeable so that the bag can be filled when lying on the ground;

the lip of the bag should be readily attachable to the device and remain securely attached while it is being filled;

the bag should be readily detachable from the device after it is filled;

A number of patents have been issued for inventions that are intended to meet these requirements.

One type of device comprises a telescoping frame which is expandable so that the frame can be positioned inside the bag near the mouth and then expanded to secure the bag to the frame. Examples of this construction include U.S. Pat. No. 4006928 to Bengin, U.S. Pat. No. 3924803 to Paulus and U.S. Pat. No. 4,5305,533 to Dieter.

Another construction comprising strip sections hinged together end to end is found in U.S. Pat. No. 4,832,291 to Nelson. The hinged joints are constructed so as to form "a smooth curve" around which the lip of the bag is fitted. It will be shown in later paragraphs of this specification that the Nelson Patent teaches away from the features of the instant invention.

U.S. Pat. No. 3,754,785 to Anderson discloses a frame made of two telescoping sections that is positioned in the mouth of the bag. A spring moves the sections apart in order to spread open the mouth of the bag.

Another type of device comprises sections of a frame joined by hinges wherein the mouth of the bag is opened by rotating the hinged sections. An example of this construction is U.S. Pat. No. 4,159,139 to Gawedzinski.

One problem with frames comprising hinged or telescoping sections as disclosed by the foregoing patents is that their construction is more expensive and their use more complicated than the instant invention.

Another type of device secures the bag to the frame by means of spikes attached to a frame which puncture the bag. Examples of this construction are U.S. Pat. No. 4,318,521 to Martin and U.S. Pat. No. 4,052,764 to Groff. The problem with depending on spikes to penetrate the wall of the bag in order to secure the bag is that some bags are difficult for many users to pierce and once the bag is pierced, the bag develops a large tear initiated by the pierce.

U.S. Pat. No. 4,775,123 to Borland is representative of a construction in which the lip of the bag is inserted into a number of slots in the device to secure the bag to the frame. This method of attaching and detaching the bag to and from the device is time consuming compared to the method of the instant invention.

U.S. Pat. No. 4,659,045 to Flynn discloses a hoop in which the lip of the bag is folded back around the hoop. This construction does not teach a positive means to secure the bag other than by gripping hand holds thereby simultaneously securing the bag.

U.S. Pat. No. 4,768,742 is for a "RIGID" rectangular frame made of ¼ inch diameter steel rod in which "the perimeter of the frame is slightly larger than the perimeter of the bag so that the lip of the bag must be stretched around the frame in order to secure the bag to the frame. This construction depends on consistent dimensions and consistent elasticity from bag to bag which is not always the case particularly if bags are used that are made by different manufacturers.

U.S. Pat. No. 4,664,348 to Corsant is for a trash bag holder comprising a flexible plastic strip with an intermediate straight portion for insertion into the bag. The use of broad plastic strips are not amenable to the type of holding power that is best suited for securing the lip of the bag and therefore the Corsant invention teaches away from the instant invention as will be discussed in subsequent paragraphs.

U.S. Pat. No. 4,548,372 to Lutzger is for a triangular frame of three rigid tubes to which the bag is attached by elongated clips that extend along substantially the entire length of each rod. Although the patent states that the tubular rods are joined end to end by sections of flexible tubing, the frame is rigid nevertheless because the tubes are rigid. Attachment of the bag to the frame depends on the elongated clips which are more expensive and less convenient to use than the means of attachment of the instant invention.

U.S. Pat. No. 4,664,348 to Corsaut et al discloses a simple straight elongated strip that extends around the mouth of the bag. The strip is flexible except for a section that is rigid and is laid flat on the ground in order to facilitate sweeping debris into the mouth of the bag. The bag is secured to the frame by insertion of the edge of the mouth of the bag into a number of slits arranged along the strip. This construction is more expensive than the construction of the instant invention and the method of attachment is time consuming which is particularly important when bags are to be used in rapid succession.

U.S. Pat. No. 4,052,764 to Groff discloses a flat scoop with rigid extensions, each extension attached on an edge opposing the other extension so as to form a generally U shaped frame. The mouth of the bag is positioned around the rigid U shaped frame. A pin is located on the end of each extension "for engagement through respective bag walls". The open section of frame provides an unsupported length of the lip which defeats the purpose of securing the lip when the bag is being filled.

As demonstrated in the foregoing paragraphs, there have been many devices disclosed to meet the need for a trash bag holder. However there has been little public acceptance due to the general inability of the disclosed devices to meet the public desire for a combination of economy of construction, rapid deployment, ease of attachment with no potential for tearing the bag, a flat edge for sweeping on hard surfaces such as the sidewalk, and non-bulkiness for convenience of storing when not in use or in a retailers store.

THE INVENTION

OBJECTS

Accordingly, in view of the problems associated with the devices of the prior art discussed in the foregoing paragraphs, objects of my invention include:

to provide a device to support the mouth of a trash bag in an open condition and vertical orientation when the bag is lying on the ground in order to facilitate filling the bag with trash.

to provide the means of securing the bag to the device which is more convenient by eliminating the use of notches, slits, clips clamps or other time consuming means of attachment;

to provide a flat panel laid on the ground to accommodate sweeping debris from a hard surface and to maintain the bag holder upright to receive swept or raked debris without being held by the user;

to provide a means to attach the bag holder on a wall in an open position to conveniently receive gravity fed debris and which may be accomplished without the need for enclosing the bag in a rigid receptacle;

to provide a convenient lifting handle for the user when moving the trashbag holder from one pile of debris to another;

to provide a lightweight, non bulky form for a trash bag holder that conserves space for convenience of storage and display in a retailers facility.

Additional objects and advantages of my invention will become apparent to the reader from a study of the drawings and following description.

SUMMARY

This invention is directed toward a trashbag holder which is a substantially triangular frame, one side of which is a flat elongated panel and each of the other sides is resilient rod. An end of each rod is joined to an end of the other rod by a joining means, a gripper/connector, and the other ends of the rods are secured to each end of the flat side of the tray. Therefore, when the panel lies flat on the ground, an arch formed by the two rods stands vertically with an apex at the top of the arch. The lip of the bag is stretched around the continuous surface that includes the ground side of the panel, the outside surface of the rods and the outside surface of the gripper/connector.

The joining means of the two rod ends to one another is less stiff than the main body of the rods so that the arch formed by the rods has a relatively short section at its apex that has a substantially smaller radius of curvature than the remaining sections of the rods.

The length of the perimeter of the mouth of the bag is smaller than the perimeter of the frame.

In order to attach the bag to the frame, the juncture of the rods is inserted into the bag and the tray is laid flat on the ground so that the arch is drawn upright. A section of a lip of the bag may be secured between the bottom side of the panel and the ground by the user stepping on the top side of the panel while he forces the apex of the arch toward the free section of the lip.

As the arch is slid closer to the lip of the bag, a tension is generated around the lip of the bag in contact with the outside continuous surface of the arch. The result of this tension is to generate a force by the bag against the outside continuous surface of the frame. Although the magnitude of the tension around the lip of the bag is constant, the force of the bag against the continuous surface around the frame will not be constant and will be greater on that section (the gripper/connector at the apex) where the radius of curvature of the continuous surface is smaller. In other words, the bag will push especially hard on the gripper/connector at the apex of the arch and the force will be maintained by the bowing of the two flexible rods. The result of this relatively large force of the bag on the gripper/connector area of the apex together with selection of a material to fabricate the gripper/connector that has a large coefficient of friction is to generate a very substantial frictional resistance to sliding by the bag over the gripper/connector and will therefore result in securing the bag to the frame as required particularly at the apex.

THE DRAWINGS

FIG. 5 is a view of a portion of two flexible rods connected to a gripper/connector also showing the lip of the bag in cross section.

FIG. 6 is a force diagram comparing the force Fc on the apex to the force Fr on the bowed rods generated by the lip of the bag stretched around the continuous surface including the connector/gripper and the resilient rods.

FIGS. *7a* and *7b* illustrates the bending of the rods changing the shape of the arch caused by stretching the lip over the arch.

FIG. 8 shows the use of a spring to attach the resilient rods together.

DESCRIPTION OF THE BEST MODE

The following detailed description illustrates the invention by way of example and not by way of limitation of the principles of the invention. This description will enable one skilled in the art to make and use the invention and describes several embodiments, adaptations, variations, alternatives and uses of the invention including what I presently believe to be the best mode of carrying out the invention.

Figure 1:
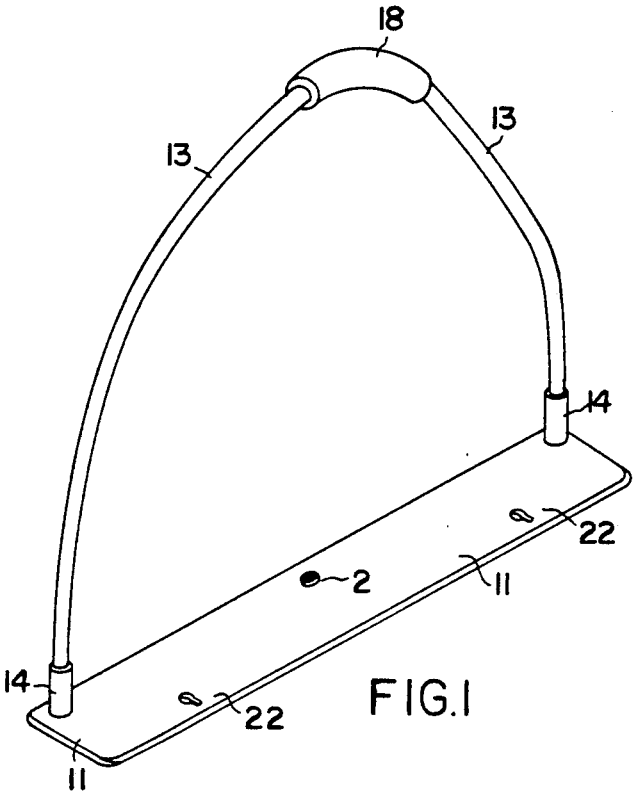
FIG. 1 is a perspective view of the trash bag holder.

Turning now to a description of the drawings, there is shown in FIG. 1 an embodiment of the trashbag holder of this invention. There is shown a flat rectangular panel 11 of substantially rigid material. A preferred material for fabricating the panel is Acrylonitrile-Butadiene-Styrene (ABS) however the panel can be made of a number of other materials such as metal, acrylic, nylon, etc. that are substantially rigid. The panel is typically 1/32 of an inch thick and has overall dimensions of 3.75×24 inches for a trash bag having a standard width of 33 inches. In the embodiment shown in FIG. 1, dimensions selected depend on the trash bag to be used.

With the panel lying flat on the ground, an erect arch is formed by two resilient rods, 13, joined together at the apex 12 of the arch and each having its other end inserted into a receptacle 14 at each end of the panel 11.

Figure 2:
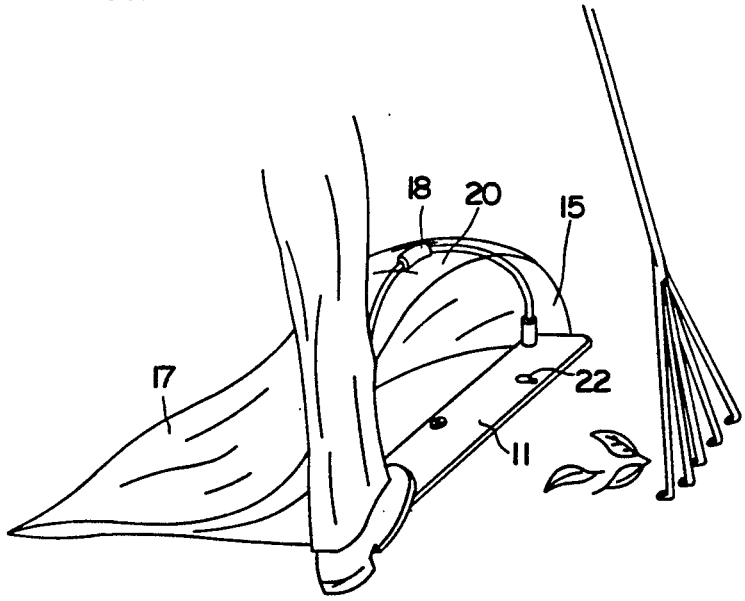
FIG. 2 is a perspective view showing the trashbag holder in use.

As shown in FIG. 2, the mouth 15 of a bag 17 is stretched around the frame formed by the panel 11 and two rods 13.

The ends of the rods 13 are joined by a gripper/connector 18 which is a short length of tubing that is less stiff than the rods. Therefore, the apex 12 of the arch will be a section of the arch where there is a much shorter radius of curvature r than the radius of curvature R of the remaining section of rod. This important feature is shown in FIG. 1 and plays an important role in securing the lip 19 of the bag 17 to the frame.

While I do not wish to be bound by theory, an explanation for this securing action is presented with reference to FIG. 5 which shows each rod 13 bent in a bow having a large radius of curvature, R, joined by a short length of tube 18 that has a smaller radius of curvature, r. The cross section 20 of the bag near the mouth (i.e., the lip of the trashbag) stretched over the arch is also shown. This stretched section of bag, i.e., the lip, is under tension and the resultant tensile force tangent to the section of arch exerts a force against the surface of the arch as shown by the force diagram in FIG. 6. In accordance with procedures of differential calculus, FIG. 6 shows an incremental length of arch, ds subject to a tensile pull, T, at one end (s1), that is equal to and opposes the tensile pull, T, at the opposite end (s2). According to the force diagram of FIG. 6, the vector sum of these two tensile forces is a force per unit area, Fc, against the surface of the gripper connector and Fr against the surface of the rod. These forces are computed to be—

$$Fr = T/R$$

against the rod and $$Fc = T/r$$

against the connector/gripper.

The principle of the invention is further illustrated by the following example:

Typically, when the bag is stretched over the frame, the periphery at the mouth of the bag is taut and generates a tensile force of 10 pounds. The radius of curvature over the apex is typically one inch or less inches. Therefore the normal force per unit area exerted at the interface between the surface of the bag and the surface of the arch at the apex is $$Fc = 20 \text{ pounds} / 1 \text{ inch} = 20 \text{ pounds per inch}$$

In contrast, the radius of curvature over the remaining section of arch is typically 30 inches. Along this section of arch, the normal force, F, is therefore only $$Fr = 20 \text{ pounds}/30 \text{ inches} = 2/3 \text{ pounds}$$

The frictional resistance pr unit length of arch to sliding of the bag surface over the surface of the arch equals the coefficient of friction between the contacting surfaces multiplied by the normal force, Fc or Fr.

Consequently, according to the foregoing theory, the resistive force per unit length to sliding of the bag off the arch is much greater (30 times in the case discussed above) at the apex than in the central section of the rod. In other words, the bag is very tightly held at the apex of the arch. This also explains why the bag stretched over an arch that includes an apex with a small radius of curvature is more secure than the hoops with large radii of curvature disclosed in the prior art.

The stretched bag resulting in the excess force on the joined ends of the rods at the apex causes the rods to bow so that the arch changes shape. The change in shape is illustrated by the force diagram in FIGS. 7*a* and 7*b* wherein the arch assumes shape A before the bag is stretched over the arch and shape B after the bag is stretched over the arch. The property of resiliency in the rods is essential for proper function of the device because it maintains the bag in the stretched condition even if the lip of the bag undergoes a permanent increase of length that can result from stretching the lip beyond its elastic limit. The resiliency of the rods in the arched shape also prevents the force of the ends of the rods from being so great that the bag is punctured by the apex. Furthermore, the forced bowing of the arch opens the mouth wider so that the bag is easier to fill.

In the preferred embodiment, the resilient rods are made of solid round acetal although other materials can be used such as vinyl, nylon, polyurethanes, etc., as well as hollow tube. The rods are typically ¼ inch in diameter by 21 inches long for a standard 33 inch trash bag.

The foregoing paragraph makes the point that it is important to select for the connector/gripper at the apex of the arch a material that has an adequately large coefficient of friction so that the force of the lip of the bag against the gripper/connector at the apex presents a frictional resistance to sliding of the lip against the surface of the gripper/connector. The gripper/connector is typically made of ¼ inch flexible tube composed of material having a shore hardness of 65 to 75 Shore A durometer to provide the required resiliency and coefficient of friction. The material may be one of a number of materials such as nylon, polyurethane or fiber glass. However, vinyl tubing sold as TYGON (R) is the preferred material because it has a relatively large coefficient of friction.

Figure 3:
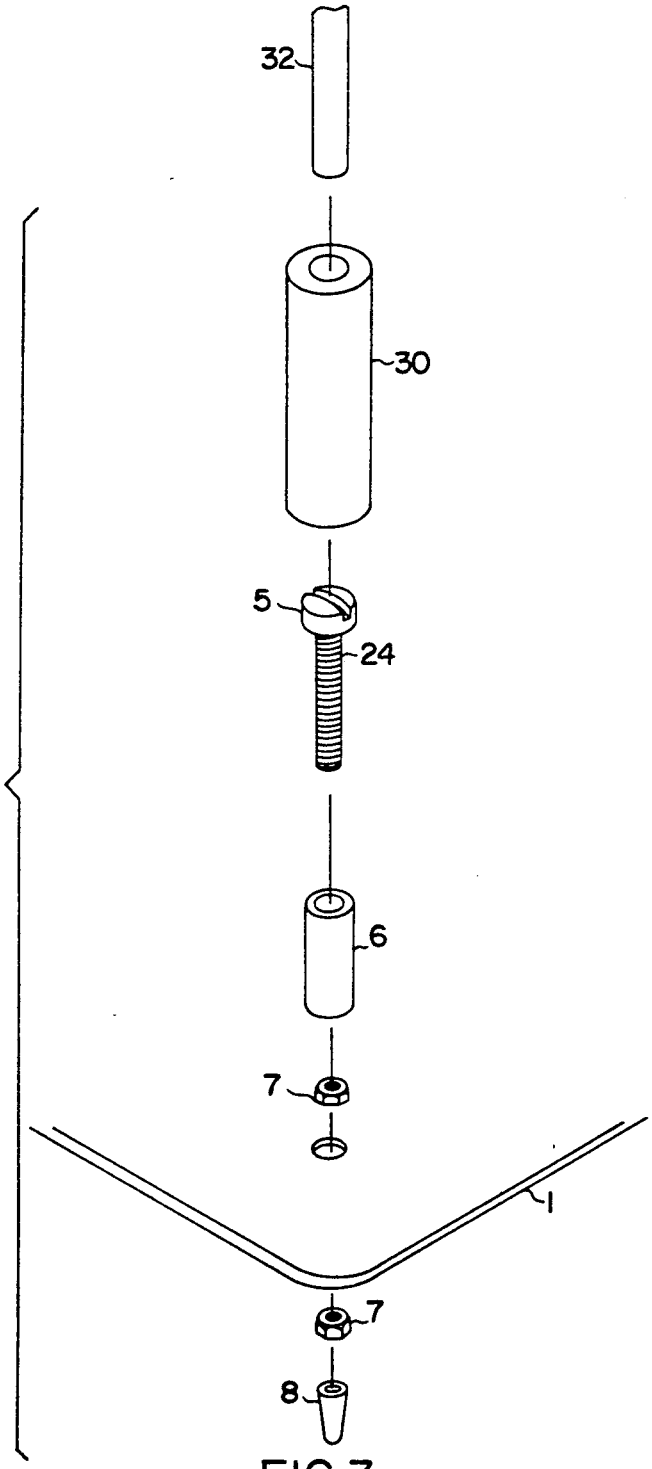
FIG. 3 is an exploded view showing how the end of the rod is attached to the panel.
Figure 4:
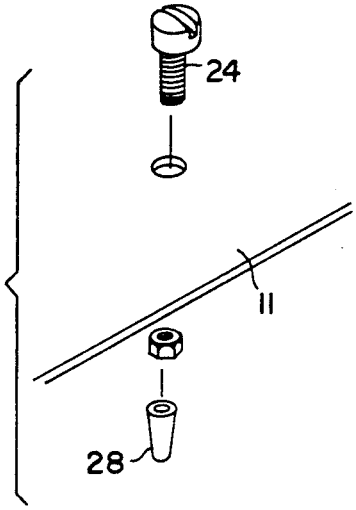
FIG. 4 is an exploded view showing the attachment of additional grippers to the ground side of the panel.

FIG. 3 is an exploded view which illustrates one method of connecting an end of each rod to respective ends of the panel. There is shown a bolt 24 passing through a post 26 on the upper side of the panel and screwed into a stud 28 on the ground side of the panel. The stud 28 helps secure the lip of the trashbag (not shown in FIG. 3). One end of a sleeve 30 slides over the post. An end 32 of the rod 13 slides into the other end of the sleeve 30. FIG. 4 shows an additional stud 28 bolted to the bottom side which cooperates with the resilient rods to increase securing power of the holder to the bag.

The steps in stretching the mouth of the bag over the frame are described as follows:

In the first step, the user pushes the apex into the bag.

In the second step, the panel is laid on the ground with a section of the lip between the panel and ground and the user steps on the panel to hold the section of lip in place.

In the third step, the user pulls the apex toward the lip, thereby flexing the arch and stretching the lip securely over the gripper/connector at the apex. The apex is about 2 inches from the edge of the mouth of the bag.

It is recommended that each corner of the panel be rounded to prevent puncturing the bag.

The leading long edge of the panel should be bevelled in order to facilitate sweeping debris across the panel and into the bag.

After the lip of the bag has been securely stretched over the frame, the user may fill the bag lying on the ground with mouth held open by the erect arch. As he fills the bag, he places one foot on the panel in order to stabilize the frame and bag as shown in FIG. 2.

Alternatively, the bag may be hung on a wall or post while being filled if that is more convenient. As shown in FIG. 1, one or more holes 22 are provided in the panel for the purpose of hanging the bag with the mouth open.

For some types of bags, it may be required to have a stronger gripper/connector than the vinyl tube described above. In these cases as shown in FIG. 8, the gripper/ connector may be a spring having one open end to receive an end of one flexible rod and another open end to receive an end of the other flexible rod.

In the foregoing paragraphs, preferred embodiments have been described which meet the objects set forth for the invention. The invention allows the user to deploy a bag holder into a trash bag quickly and easily without the cumbersome and time consuming requirement of attachment by clips, slots or notches. Furthermore, the bag holder has the additional advantages in that :

it permits the user to sweep debris into the trash bag from hard surfaces without having to use one hand to stabilize the bag holder;

it provides the user a convenient surface to lift the trash and bag holder when transporting it from one pile of debris to the next, requiring minimum bending by the user;

it permits the user to leverage the bag holder at gripper/connector when forcing in bulky debris;

it permits the bag holder to be mounted on a wall and filled in that position;

it allows for easy assembly by the user and therefore can be stored dissembled, therefore conserving space when stored or on display in a retail outlet.

It should be understood that various modifications within the scope of this invention can be made without departing from the spirit thereof. For example, the arch could be constructed from more than two lengths of flexible rod, joined end to end by short very flexible connector grippers.

In another embodiment, shown in FIG. 8, the gripper connector may be a coil spring 34. Each flexible rod 13 is inserted into an open end of the spring The surface of the spring may be treated to increase the coefficient of friction. This embodiment would be useful where it is desireable to have a greater strength of the connector gripper than is provided by vinyl tubing.

The commonality among all the embodiments is a frame comprising sections at least two of which are flexible and joined by connector/gripper members so as to define a continuous surface around the frame. The continuous surface in the direction around the frame has a curvature around the frame whose radius is much smaller around the connector/gripper section than any radius of curvature assumed by the flexible sections. The curvature lies in the plane of the tension imposed by the lip of the bag. The flexible property of the sections is necessary to maintain the frame in forced contact with the lip of the bag. The small radius of curvature around the connector/gripper ensures that a large force is exerted by the bag against the gripper/connector. Selection of a material for the gripper/connector that has a large coefficient of friction will therefore ensure a large resistance to sliding that will occur between the surface of the bag and the surface of the connector/gripper thereby securing the bag to the frame. Additional grippers (studs) on the bottom side of the panel, providing a small radius of curvature of the lip in this region, similarly act in consort with the flexible rods to strengthen the attachment of the lip of the bag holder. Therefore, selection of material having a large coefficient of friction to make the studs, further secures the bag to the holder. None of the prior art discussed in the background use a combination of flexible rods and flexible gripper/connectors to invoke the principles of this commonality. The principles of this commonality provides a convenience of use and an economy of construction that is not provided by the devices of the prior art.

I therefore wish my invention to be defined by the scope of the appended claims as broadly as the prior art will permit and inview of the specification if need be.

I claim:

1. A holder for trash which comprises:

a trashbag having a continuous lip with a length of said lip;

a substantially rectangular panel bounded by two long edges opposed to one another, two short edges opposed to one another, a top side and a bottom side;

two resilient rods, each having a first end and a second end;

means for securing said first ends of said rods perpendicularly to said top side, one first end adjacent to one of said short edges and the other first end adjacent to the other short edge;

means for flexibly joining said second ends together thereby defining a continuous surface having a length outside and around a frame of said joined rods and panel;

said rods and panel selected to provide that said length of said continuous surface is greater than said length of said lip;

said surface having a curvature around said frame and along which said lip of said trash bag may be stretched in contact with said continuous surface to provide tension that causes said resilient rods to bend;

said joining means being substantially less stiff than said rods thereby providing that said curvature have a substantially smaller radius around said joining means than around said resilient rods and thereby generating frictional force against said joining means that resists sliding of said lip in contact with said joining means to secure said lip to said frame and maintain said trashbag in an open condition to permit a user to put debris in said open trashbag.

2. A trashbag holder as in claim 1 wherein curvature of surface over said means for joining said resilient members has a radius that is less than one inch.

3. A trash bag holder as in claim 1 wherein said securing means comprises a rigid tube having two open ends, one open end secured to said top side and said other open end oriented to receivingly engage one of said first ends perpendicular to said top side.

4. A trash bag holder as in claim 1 wherein said joining means comprises a flexible tube having two open ends, each open end recievingly engaging said second end of one of said resilient rods.

5. A trash bag holder as in claim 4 wherein said flexible tube is made of material selected from the group that consists of reinforced inner-braided-polyvinylchloride, rubber, vinyl, polyurethane and neoprene.

6. A trashbag holder as in claim 5 wherein said material has a shore A durometer hardness between 75 to 80.

7. A trash bag as in claim 1 wherein said panel is made of material selected from the group that consists of Acrylonitrile-Butadiene-Styrene, acrylic, nylon, metal and rubber.

8. A trashbag holder which comprises:

a substantially rectangular panel bounded by two long edges and opposed to one another, two short edges opposed to one another, a top side and a bottom side;

two resilient rods, each having a first end and a second end;

means for securing said first ends perpendicularly to said top side, one said first end adjacent to one of said short edges and said other first end adjacent to said other short edge, each said securing means including a rigid tube having one open end receivingly engage one of said first ends and another open end secured to said topside by a stud bolted to said top side and protruding into said another open end of said tube;

means for flexibly joining said second ends together thereby defining a frame having a continuous surface outside and around said frame;

said surface having a curvature around said frame along which a kip of a trash bag may be stretched in contact with said continuous surface to provide tension that causes said resilient rods to bend;

said joining means being substantially less stiff than said rods thereby providing that said curvature have a substantially smaller radius around said joining means than around said resilient rods and thereby generate frictional force of said lip against said joining means and to maintain said trashbag in an open condition to permit a user to put debris in said open trashbag.

9. A trashbag holder as in claim 8 wherein said securing means are located adjacent to a first one of said long edges thereby permitting a user to position said trash bag on the ground and place one foot on said top side of said panel to secure a portion of said lip between said bottom side and ground with a remaining portion of said lip stretched over said arch to facilitate sweeping trash into said trashbag extending away from said first edge.

10. A trashbag holder as in claim 9 wherein said second edge is operably bevelled to further facilitate sweeping debris from the ground into said trashbag.

11. A trashbag holder as in claim 9 wherein said panel has at least two holes operably positioned to permit hanging said trashbag holder against a wall by inserting spikes in said wall through said holes.

12. A trashbag holder as in claim 8 which has rounded corners where said long edges meet said short edges.

13. A trashbag holder as in claim 8 wherein said joining means is a coil spring having on open end to receivingly engage said second end of one resilient rod and another open end to receivingly engage said second end of other said resilient rod.

14. A trashbag holder as in claim 8 which further comprises at least one stud perpendicularly attached to said ground side of said panel thereby further securing said lip to said holder.

* * * * *